US006305579B1

(12) United States Patent
Long, Jr.

(10) Patent No.: US 6,305,579 B1
(45) Date of Patent: Oct. 23, 2001

(54) SNAP-ON SCREW-OFF CLOSURE

(75) Inventor: Charles J. Long, Jr., New Castle, PA (US)

(73) Assignee: International Plastics and Equipment Corporation, New Castle, PA (US)

( * ) Notice: Subject to any disclaimer, the term of this patent is extended or adjusted under 35 U.S.C. 154(b) by 0 days.

(21) Appl. No.: 09/414,179

(22) Filed: Oct. 7, 1999

Related U.S. Application Data

(63) Continuation-in-part of application No. 09/145,690, filed on Sep. 2, 1998, which is a continuation-in-part of application No. 08/961,440, filed on Oct. 30, 1997, now Pat. No. 6,059,134.

(51) Int. Cl.[7] ..... B65D 41/34

(52) U.S. Cl. ..... 222/153.06; 222/153.02; 222/525

(58) Field of Search ..... 222/153.02, 153.05, 222/153.06, 153.07, 522–525; 215/252, 253, 318, 320, 321

(56) References Cited

U.S. PATENT DOCUMENTS

| | | | | |
|---|---|---|---|---|
| 5,487,481 | * | 1/1996 | Sander et al. | 215/252 |
| 5,588,562 | * | 12/1996 | Sander et al. | 222/153.06 |
| 5,593,055 | * | 1/1997 | Repp et al. | 215/318 |
| 5,657,906 | | 8/1997 | Rapchak et al. | 222/153.07 |
| 5,662,247 | | 9/1997 | Rapchak et al. | 222/153.07 |
| 5,975,369 | * | 11/1999 | Yurkewicz et al. | 222/153.06 |
| 6,050,452 | * | 4/2000 | Pradinas | 222/153.02 |

FOREIGN PATENT DOCUMENTS

| | | | | |
|---|---|---|---|---|
| 1536459 | * | 7/1968 | (FR) | 215/253 |

* cited by examiner

*Primary Examiner*—J. Casimer Jacyna
(74) *Attorney, Agent, or Firm*—Cohen & Crigsby, P.C.

(57) ABSTRACT

The present invention provides a closure with a thread configuration adapted for snap-on or screw-on application to a container neck finish. The present invention preferably provides at least one annular sealing bead depending from the outer surface of the closure valve which are compressed against the inner surface of the container neck to form a seal as the closure is snapped onto the container neck. The present invention also preferably provides plurality of elevated areas extend upwardly from the tamper-evident band in spaced relation to the bottom edge of the closure body to support the tamper evident band in resisting vertical movement imparted by insertion of the closure on the bottle neck, thereby protecting the frangible elements during assembly. At least one and preferably a plurality of circumferentially spaced lugs optionally extend from the exterior wall of the container neck to facilitate breaking the frangible elements on the tamper-evident band of the closure by engaging the frangible elements as the closure is twisted off the container neck following initial snap-on application. The closure is optionally provided with at least one member attached to the tamper-indicating ring which cooperates with the arcuate projection to assist in breaking said tamper indicating ring during removal of the closure from the container neck. A second preferred embodiment of the present invention provides a threaded tamper-evident plastic closure having a tamper-evident band containing the above-described features, for use with a tamper evident push-pull resealable pour spout which is substantially leak proof. The present invention also optionally provides a dust cover which encloses the push-pull pour spout closure when inserted on the container. When the dust cover is provided with a tamper-evident sealing band, the use of a band on the lower edge of the pour spout closure for providing tamper-evidency may be eliminated.

49 Claims, 11 Drawing Sheets

SNAP-ON SCREW-OFF CLOSURE

This application is a continuation-in-part (CIP) of U.S. patent application Ser. No. 09/145,690 filed Sep. 2, 1998, and still which is a CIP of U.S. patent application Ser. No. 08/961,440 filed Oct. 30, 1997, now U.S. Pat. No. 6,059,134 the disclosures of which are both incorporated herein by reference.

FIELD OF THE INVENTION

The present invention relates to a closure and neck finish for blow-molded containers and in particular to a snap-on closure with a tamper evident locking feature that can be screwed off the container after initial application and then reapplied by screwing the closure onto the container.

RELATED APPLICATIONS

One family of related patent applications assigned to the assignee of the present application include U.S. patent application Ser. No. 09/067,583 filed Apr. 28, 1998, which is a continuation-in-part of U.S. patent application Ser. No. 08/948,342 filed Oct. 8, 1997, which is a continuation-in-part of U.S. patent application Ser. No. 08/927,311 filed Sep. 11, 1997, which is a continuation-in-part of U.S. patent application Ser. No. 08/749,488 filed on Nov. 15, 1996, which is a continuation-in-part of U.S. patent application Ser. No. 08/603,148 filed on Feb. 15, 1996. Another family of related patent applications assigned to the assignee of the present application include U.S. patent application Ser. No. 08/927,743 filed Sep. 11, 1997, which is a continuation-in-part of U.S. Pat. application Ser. No. 08/838,133 filed on Apr. 15, 1997, which is a continuation-in-part of U.S. patent application Ser. No. 08/687,149 filed on Jul. 24, 1996, which is a continuation-in-part of U.S. patent application Ser. No. 08/633,225 filed on Apr. 16, 1996.

BACKGROUND OF THE INVENTION

Tamper evident caps for containers, such as blow-molded or injection molded containers are well known, see e.g., U.S. Pat. Nos. 4,561,553, 4,625,875, 4,497,765, and 4,534,480. A number of caps are of the snap-on screw-off variety such as U.S. Pat. Nos. 5,553,727, 5,190,178, 5,213,224, 5,267,661, 5,285,912, 5,480,045, 5,456,376, and 5,307,946 and 5,560, 504. Generally, the prior art caps include a spiral thread or threads which match a spiral thread on the neck of the bottle. In U.S. Pat. No. 5,307,946 the cap and bottle neck include a seven lead-in end annular spiral thread configuration (or fastening means) and in U.S. Pat. No. 5,553,727 the cap and bottle neck include a ten lead-in end annular spiral thread configuration (or fastening means). The advantage of the multiple lead-in threads is the increased ease of "snap-on" placement of the cap onto the threaded neck using standard bottle capping equipment and without an additional tightening step such as a final twist.

As is apparent from the prior art patents, a great deal of effort has gone into design of cap and bottle neck configurations to provide easy on and off use of the cap by the bottler and ultimately by the end user of the bottled product. However, notwithstanding this effort, the bottling industry continues to search for a cap and neck finish which achieves these objectives but which also provides a secure seal.

The present invention solves this problem by optionally providing at least one annular sealing bead depending from the outer surface of the closure valve which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also solves the problem of protecting the integrity of frangible elements during installation of threaded tamper-evident closures. A plurality of elevated areas extend upwardly from the tamper-evident band in spaced relation to the bottom edge of the closure body. The purpose of these elevated areas is to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band. The purpose of attaching frangible elements to the elevated areas of the tamper-evident band is to assist in preventing axial misalignment of the tamper-evident band relative to the annular depending skirt portion of the closure upon subjecting the closure to torquing forces during assembly to the container neck.

At least one and preferably a plurality of circumferentially spaced lugs optionally extend from the exterior wall of the container neck. These lugs facilitate breaking the frangible elements on the tamper-evident band of the closure by engaging the frangible elements as the closure is twisted off the container neck following initial snap-on application.

Additionally, the tamper indicating closure may include at least one arcuate projection extending around at least a portion of the tamper indicating ring arranged for registration with an annular locking flange on a container neck portion on which the closure is positioned. The closure is provided with at least one member attached to the tamper-indicating ring which cooperates with the arcuate projection to assist in breaking the tamper indicating ring during removal of the closure from the container neck. The arcuate projection is held in place by the locking flange on the container neck as the member is pulled away from the arcuate projection during twist-off removal of the closure body to cause the tamper indicating ring to break at a weakened area. Finally, the bottle neck finish may be optionally configured with a recessed area in which the tamper indicating ring of the closure rests. The closure is installed and the tamper indicating ring removed in the same manner as with a non-recessed bottle neck finish, but the recessed configuration improves tamper evidency protection by eliminating the ability to manually pry the closure upwardly from underneath the tamper indicating ring in order to remove the closure from the neck finish without breaking the tamper indicating ring.

Prior art threaded push-pull pour spout closures providing tamper evidency and having tamper evident pour spouts have not always been leak proof at the spout closure interface. Generally, prior art push-pull pour spout closures that are reusable do not provide effective sealing at the juncture between the spout opening and the plug positioned in the opening when the spout is closed. Because of the very small diameter of the opening and the concern for safety, it is not possible to add non-integrated sealing means. The present invention solves this problem by utilizing a closure plug which combines a circular closure disk with an integral annular skirt depending from the periphery of the disk thereby defining a hollow cavity for the plug interior and increasing the structural flexibility of the plug. The increased structural flexibility provided by the hollow cavity causes inward deformation of the plug skirt upon engagement with annular flanges integrated into the periphery of the spout closure central opening to create a form-fitting leak tight seal. A plurality of circumferentially spaced dimples optionally extend from the exterior wall of the pour spout. These dimples facilitate breaking the frangible elements connecting the tamper evident band to the push-pull pour spout closure. Optionally, one or more continuous or discontinuous locking beads on the pour spout can be configured to engage one or more continuous or discontinuous locking beads on the pour spout closure to provide a structure for securing the pour spout closure to the pour spout the closed position and/or to prevent removal of the pour spout closure from the pour spout in the open position.

The present invention also optionally provides a dust cover which encloses the push-pull pour spout closure when inserted on the container. One example of the use of dust covers as a means for sealing containers is shown in U.S. Pat. No. 5,456,374. The dust cover of the present invention is optionally provided with a tamper-evident sealing band which remains intact upon initial installation of the dust cover onto the container and which is broken when the dust cover is initially disturbed. The purpose of the dust cover is to provide an indication of whether the push-pull pour spout closure has been exposed subsequent to the sealing of the container. When the dust cover is provided with a tamper-evident sealing band, the use of a band on the lower edge of the pour spout closure for providing tamper-evidency may be eliminated.

Accordingly, it is an object of the present invention to improve sealing engagement between the closure and the mating portions of the interior wall of the container neck by including at least one annular sealing bead depending from the outer surface of the closure valve which are compressed against the inner surface of the container neck to form a seal as the closure is snapped onto the container neck.

It is a further object of the present invention to improve sealing engagement between the closure and the mating portions of the exterior wall of the container neck by including one or more annular sealing beads on the interior surface of the closure depending annular skirt.

It is a further object of the present invention to provide a lug configuration for facilitating the breakage of frangible elements on the tamper evident band of the closure.

It is a further object of the present invention to provide a threaded tamper-evident closure having frangible elements attached from and between a plurality of elevated areas extending upwardly from the tamper-evident band, for protecting the integrity of frangible elements during installation of the closure on a bottle neck.

It is a further object of the present invention to provide a closure with at least one member attached to the tamper-indicating ring which cooperates with the arcuate projection to assist in breaking the tamper indicating ring during removal of the closure from the container neck.

It is a further object of the present invention to provide a closure and bottle neck finish with a recessed area in which the tamper indicating ring of the closure rests so as to improve tamper evidency protection by eliminating the ability to manually pry the closure upwardly from underneath the tamper indicating ring in order to remove the closure from the neck finish without breaking the tamper indicating ring.

It is a further object of the present invention to provide a threaded tamper-evident closure with a reusable push-pull pour spout having a closure plug of increased structural flexibility to provide a more effective leak tight seal.

It is a further object of the present invention to provide a dimple means for facilitating the breakage of frangible elements on the tamper evident band of the push-pull pour spout closure.

It is a further object of the present invention to provide a threaded tamper-evident closure with a reusable push-pull pour spout that utilizes an upwardly angled hook-shaped annular flange to prevent removal of the closure body from a bottle neck while the tamper evident band remains intact.

It is a further object of the present invention to provide a threaded tamper-evident closure with a reusable push-pull pour spout having a plurality of fins or gussets extending upwardly from and in a direction substantially perpendicular to the sealing surface of an annular hook-shaped flange, to assist in breaking and dislodging the tamper-evident band from the remainder of the closure body.

It is a further object of the present invention to provide frangible elements attached from and between a plurality of elevated areas extending upwardly from the tamper-evident band, for protecting the integrity of frangible elements during installation of the closure on a bottle neck.

It is a further object of the present invention to provide one or more continuous or discontinuous locking beads on the pour spout configured to engage one or more continuous or discontinuous locking beads on the pour spout closure to provide a structure for securing the pour spout closure to the pour spout the closed position and/or to prevent removal of the pour spout closure from the pour spout in the open position.

It is a further object of the present invention to provide a dust cover which encloses the push-pull pour spout closure when inserted on the container.

It is a further object of the present invention to provide a dust cover with a tamper-evident sealing band which encloses the push-pull pour spout closure when inserted on the container.

It is a further object of the present invention to eliminate the need for a band on the lower edge of the pour spout closure to provide tamper-evidency for the pour spout by providing a dust cover with a tamper-evident sealing band which encloses the push-pull pour spout closure when inserted on the container.

SUMMARY OF THE INVENTION

The present invention provides a closure with a thread configuration adapted for snap-on or screw-on application to a container neck finish. Preferably the closure and neck finish contain eight or nine mating continuous or discontinuous threads for this purpose.

The present invention preferably provides at least one annular sealing bead depending from the outer surface of the closure valve which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also preferably provides plurality of elevated areas extend upwardly from the tamper-evident band in spaced relation to the bottom edge of the closure body to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band to assist in preventing axial misalignment of the tamper-evident band relative to the annular depending skirt portion of the closure upon subjecting the closure to torquing forces during assembly to the container neck.

Additionally, the tamper indicating closure may include at least one arcuate projection extending around at least a portion of the tamper indicating ring arranged for registration with an annular locking flange on a container neck portion on which the closure is positioned. The closure is optionally provided with at least one member attached to the tamper-indicating ring which cooperates with the arcuate projection to assist in breaking the tamper indicating ring during removal of the closure from the container neck. The arcuate projection is held in place by the container neck as the member is pulled away from the arcuate projection during twist-off removal of the closure body to cause the tamper indicating ring to break at a weakened area. Finally, the bottle neck finish may be optionally configured with a recessed area in which the tamper indicating ring of the closure rests. The closure is installed and the tamper indicating ring removed in the same manner as with a non-recessed bottle neck finish, but the recessed configuration improves tamper evidency protection by eliminating the ability to manually pry the closure upwardly from underneath the tamper indicating ring in order to remove the closure from the neck finish without breaking the tamper indicating ring.

At least one and preferably a plurality of circumferentially spaced lugs optionally extend from the exterior wall of the container neck to facilitate breaking the frangible elements on the tamper-evident band of the closure by engaging the frangible elements as the closure is twisted off the container neck following initial snap-on application.

A second preferred embodiment of the present invention provides a threaded tamper evident plastic closure having a tamper-evident band containing the above-described features, for use with a tamper evident push-pull resealable pour spout which is substantially leak proof. The push-pull pour spout has an opening which is partially closed by a second top having a secondary opening therein and a plug spaced thereabove with upwardly angled legs formed integrally with the closure. The plug takes the form of a circular closure disk having an integral annular skirt depending from the periphery of the disk that attaches the plug to the angular legs thereby defining a hollow cavity for the plug interior and increasing the structural flexibility of the plug. Integrated into the periphery of the secondary opening is at least one and preferably two annular flanges which engage the plug skirt when the secondary opening is closed to seal the spout. The annular flanges cause inward deformation of the plug skirt upon engagement to create a form-fitting leak proof seal. A plurality of circumferentially spaced dimples optionally extend from the exterior wall of the pour spout. These dimples facilitate breaking the frangible elements connecting the tamper evident band to the spout closure. Optionally, one or more continuous or discontinuous locking beads on the pour spout can be configured to engage one or more continuous or discontinuous locking beads on the pour spout closure to provide a structure for securing the pour spout closure to the pour spout the closed position and/or to prevent removal of the pour spout closure from the pour spout in the open position.

The present invention also optionally provides a dust cover which encloses the push-pull pour spout closure when inserted on the container. The dust cover may optionally be provided with a tamper-evident sealing band which remains intact upon initial installation of the dust cover onto the container and which is broken when the dust cover is initially disturbed. When the dust cover is provided with a tamper-evident sealing band, the use of a band on the lower edge of the pour spout closure for providing tamper-evidency may be eliminated.

Other advantages of the present invention will become apparent by a perusal of the following detailed description of a presently preferred embodiment of the invention taken in connection with the drawings.

DETAILED DESCRIPTION OF THE PRESENTLY PREFERRED EMBODIMENT

Figure 1:
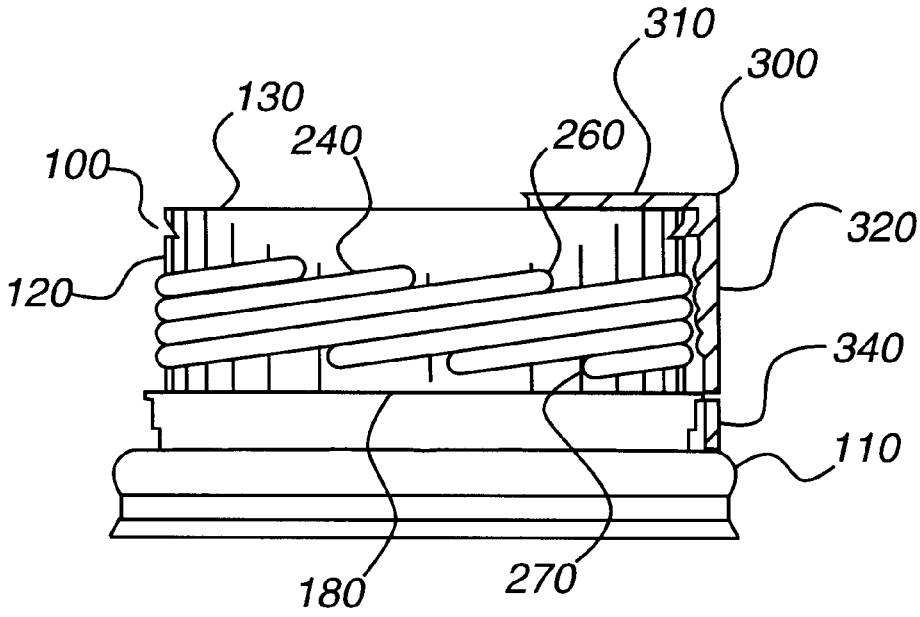
FIG. 1 is an elevation in partial section of a bottle neck finish and closure according to the present invention.
Figure 1A:
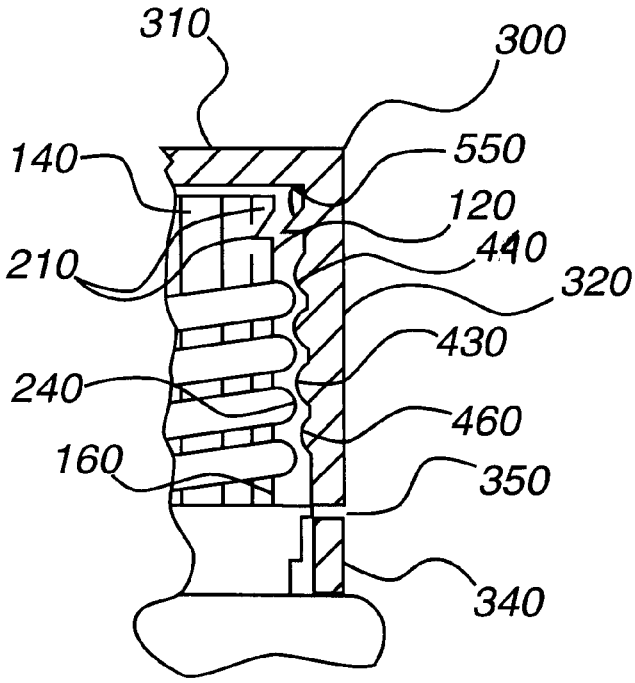
FIG. 1A is an enlarged view of the circumferential mating engagement of the closure and container neck shown in FIG. 1.

Referring to FIGS. 1 and 1A, the neck finish 100 of a container 110 is partially shown. Neck finish 100 is preferably made of plastic and more preferably a high density plastic suitable for blow molding manufacture of the neck finish 100. Neck finish 100 includes an annular wall 120 having a first end 140 and a second end 160 and defining a cylindrical opening 130 within the neck finish 100, with first end 140 providing access to opening 130.

Positioned adjacent to second end 160 is at least one and preferably a plurality of circumferentially spaced lugs 180 extend from the exterior wall of the container neck. Lugs 180 may be preferably positioned around the entire circumference of the annular wall 120 or alternately only a portion thereof. Lugs 180 facilitate breaking the frangible elements on the tamper-evident band 340 of the closure 300 by engaging frangible elements 350 connecting the tamper-evident band 340 to the closure 300 as the closure 300 is twisted off the container neck 100 following initial snap-on application of the closure 300.

Helically extending between first end 140 and the second end 160 of the annular wall 120 are an appropriate number of threads to permit snap-on or screw-on application, preferably eight or nine threads 240 terminating at points 260 and 270 proximate to the first end 140 and second end 160 of annular wall 120, respectively. Preferably, threads 240 are helically spaced in a continuous relationship as shown in FIG. 1 but threads 240 can alternately be discontinuous and can take on any cross-sectional profile suitable for mating with threads 430 on the closure 300 during snap and screw-on application of the closure 300 to the neck finish 100.

Closure 300 is preferably made from a low or high density polypropylene suitable for blow molding manufacturing. Cap 300 comprises a closure member 310 designed to cover the cylindrical opening 130 of the container neck finish 100. In a preferred embodiment of the invention, closure member 310 is substantially circular and an annular wall 320 circumferentially surrounding at least a portion of neck finish 100 depends from closure member 310.

Figure 2:
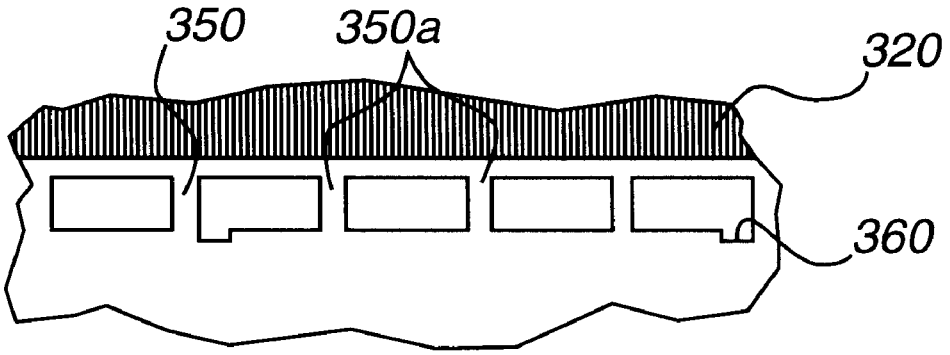
FIGS. 2 and 2A are enlarged sectional views of the tamper-evident band of the closure of the present invention.
Figure 2A:
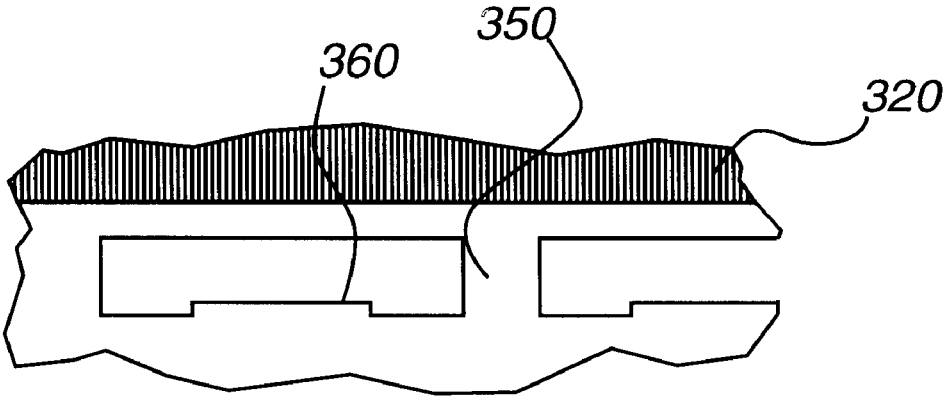

Annular wall 320 includes a tamper-evident band 340 around the end opposite the closure member 310. Tamper-evident band 340 includes at least one and preferably a plurality of frangible elements 350 extending around at least a portion of the circumference of the tamper-evident band 340. As shown in FIGS. 2 and 2A, at least one and preferably a plurality of elevated areas 360 extend upwardly from the tamper-evident band 340 in spaced relation to the bottom edge of annular wall 320. The purpose of these elevated areas is to support the tamper evident band 340 in resisting vertical movement imparted by insertion of the closure on the bottle neck, thereby protecting the frangible elements 350 during assembly. As shown in FIG. 2, the frangible elements 350*a*-connecting the tamper-evident band 340 to the lower edge of annular wall 320 may be configured to extend from these elevated areas 360 as well as from the non-elevated areas of the tamper-evident band 340. The purpose of attaching frangible elements to the elevated areas 360 of the tamper-evident band 340 is to assist in preventing axial misalignment of the tamper-evident band 340 relative to the annular wall portion 320 of the closure 300 upon subjecting the closure 300 to torquing forces during snap-on assembly to the container neck finish 100.

Figure 4:
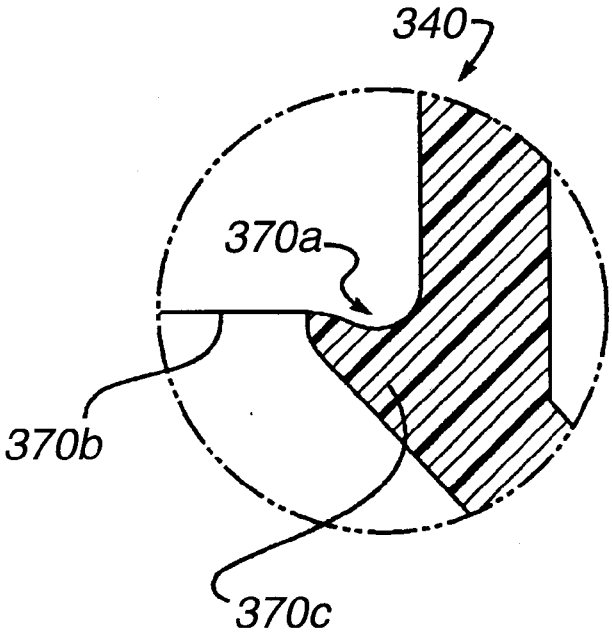
FIG. 4 is an exploded view of the arcuate locking projection of the present invention.

Optionally, tamper-evident band 340 may be configured with at least one or more arcuate flanged locking projections 370 circumferentially spaced about the inner surface of the tamper evident ring 340 and positioned so that they are engageable under an annular locking flange on a bottle neck (not shown) to lock the closure 300 on the bottle neck. As can be seen in FIG. 4, arcuate projections 370 can for example comprise edges 370*a* defining grooves 370*b* formed on radially upwardly extending annular flanges 370*c*. Flanges 370*c* can be discontinuous or continuous. Edge 370*a* and groove 370*b* provide a "hook" shape for engaging the annular locking flange on the container neck (not shown) which has a radius substantially the same as groove 370*b*. The surface of flange 370*c* may lie at an angle with a plane normal to the inner surface of the tamper-evident band 340, thereby defining a grooved "hook" with a reverse basis allowing flange 370*c* to slide over the locking flange on the bottle neck when the closure is placed on the container but which engages and locks the closure to the container when removal of the closure is attempted with the tamper-evident band 340 intact. The aforementioned angle may vary over the surface of flange 370*c* such that at least a portion of the flange surface lies substantially parallel to the interior surface of the tamper indicating band 340. This flanged edge and groove configuration 370*a*-370*c* may be positioned at any elevation on the surface of tamper. evident band 340, including a position adjacent to the bottom edge of tamper-evident band 340 as shown in FIG. 4. Because groove 370*b* is undercut, a mold core must be used that frees or permits removal of undercut prior to stripping the closures from the mold. Various techniques are known to those skilled in the art including the use of movable core sleeves which free the undercut section of the mold.

Figure 5:
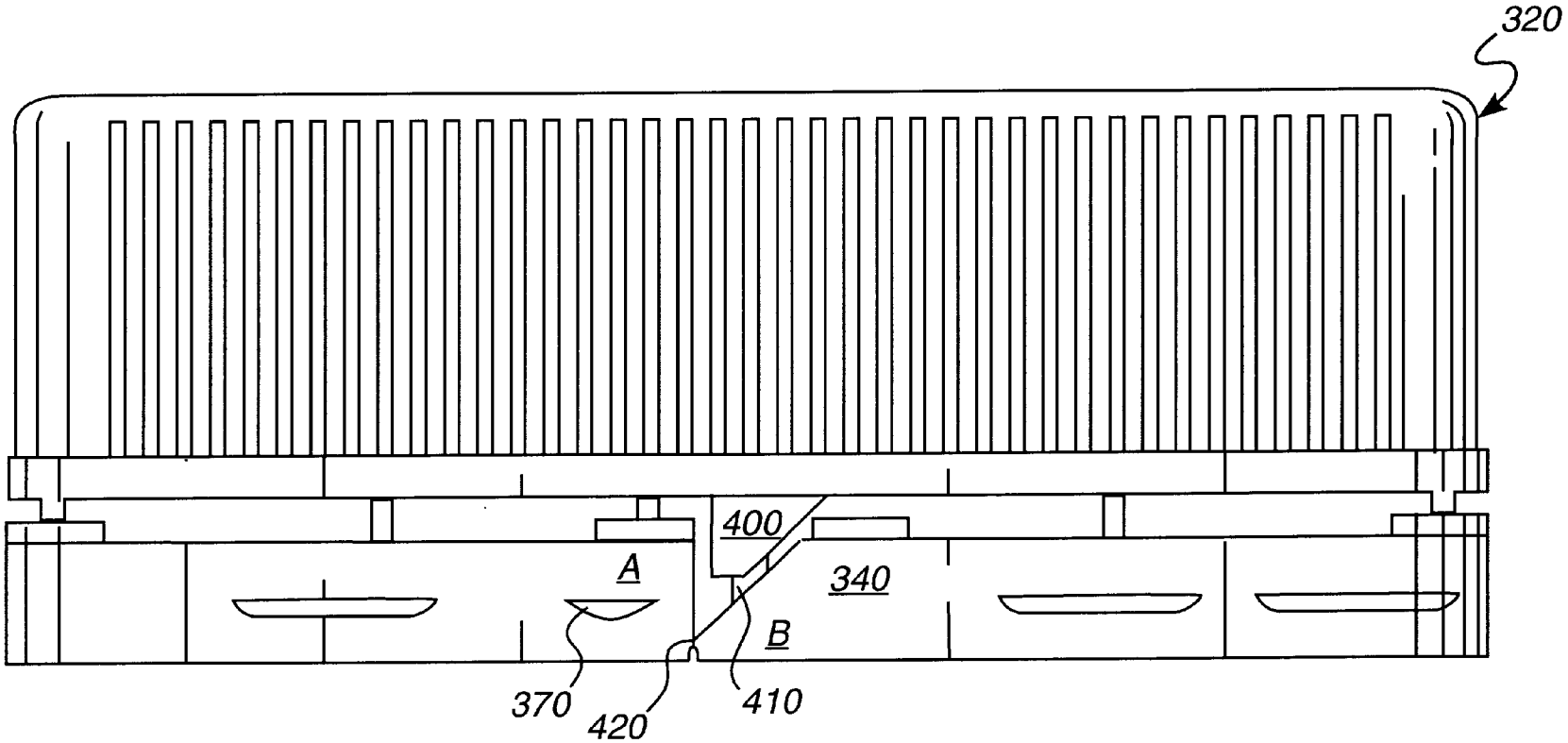
FIG. 5 is a plan view of the closure showing the cooperation of the arcuate locking projection with a member extending from the closure body to facilitate breaking the tamper-evident band.

As shown in FIG. 5, tamper-evident band 340 is also attached to a member 400 extending from annular wall 320 to facilitate breaking the tamper-evident band 340 when unscrewing the closure 300 to remove it from the neck finish 100 of the container 110. Preferably member 400 is also attached to the tamper-evident band 340 by a strip 410 of material extending between member 400 and tamper-evident band 340 and located proximate to a weakened area 420 formed in the tamper evident band 340. The unscrewing of the closure 300 from the container neck finish 100 produces an upward force on the member 400 which is translated through strip 410 to the attached portion B of the tamper-evident band 340. This upward force acts in concert with a downward force exerted by interference between the container neck finish 100 and the portion A of the tamper-evident band 340 containing arcuate flange 370 to cause the weakened area 420 to rupture, thereby breaking the tamper-evident band 340 to allow the closure 300 to be removed from the container 110. The tamper-evident band 340 will remain with the closure 300 due to the strip 410 attaching the member 400 to the tamper-evident band 340. Strip 410 can subsequently be completely broken away to allow removal of the tamper-evident band 340 from the closure 300.

Figure 6:
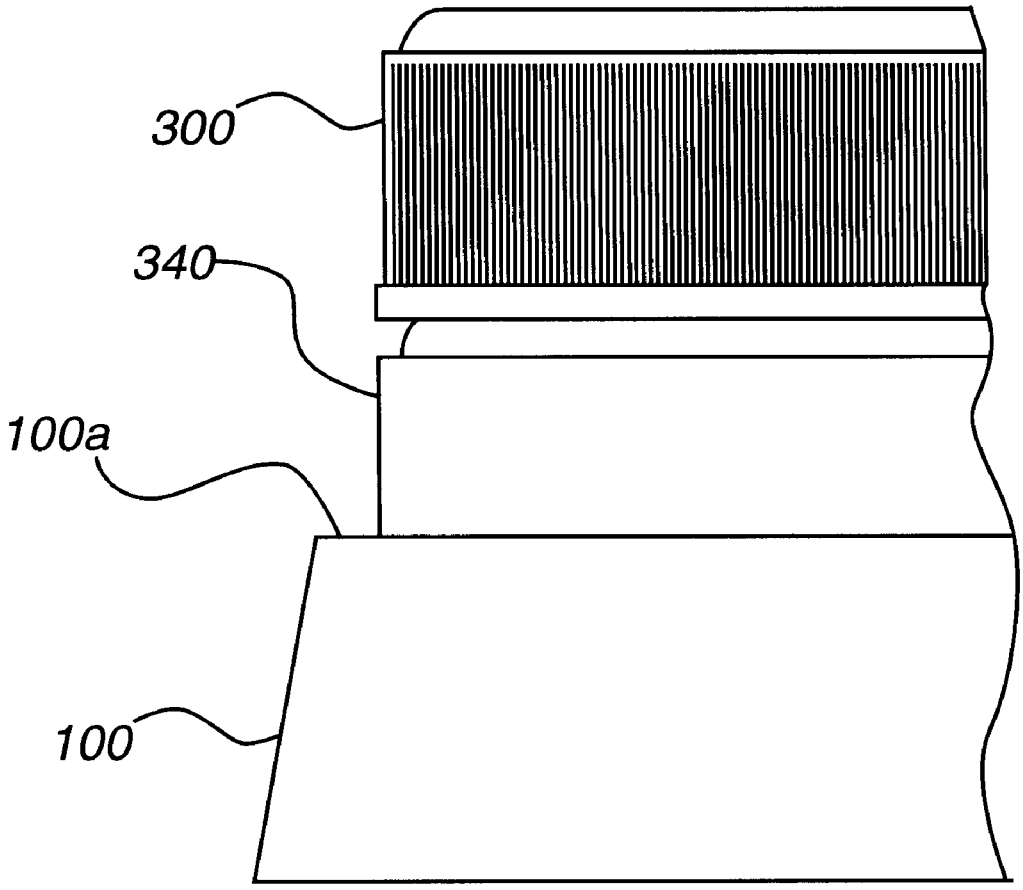
FIG. 6 is a plan view of the closure and container neck finish configured with a recessed area in which the tamper indicating ring of the closure rests.

As shown in FIG. 6, the container neck finish 100 may be optionally configured with a recessed area 100*a* in which the tamper indicating ring 340 of the closure 300 rests. The closure 300 is installed and the tamper indicating ring 340 removed in the same manner as described above with a non-recessed container neck finish 100, but the recessed area 100*a* improves tamper evidency protection by eliminating the ability to manually pry the closure 300 upwardly from underneath the tamper indicating ring 340 in order to remove the closure 300 from the neck finish 100 without breaking the tamper indicating ring 340.

Extending from a location proximate to closure member 310 to a location proximate to tamper-evident band 340 are an appropriate number of threads to permit snap-on or screw-on application, preferably eight or nine helically spaced threads 430 on the inner surface of annular depending wall 320 each having respective lead openings 440 and 460. Preferably, closure threads 430 are helically spaced in a continuous relationship as shown in FIG. 1A but threads 430 can alternately be discontinuous and can take on any cross-sectional profile suitable for mating with threads 240 on the container neck finish 100 during snap and screw-on application of the closure 300 to the neck finish 100.

Figure 3:
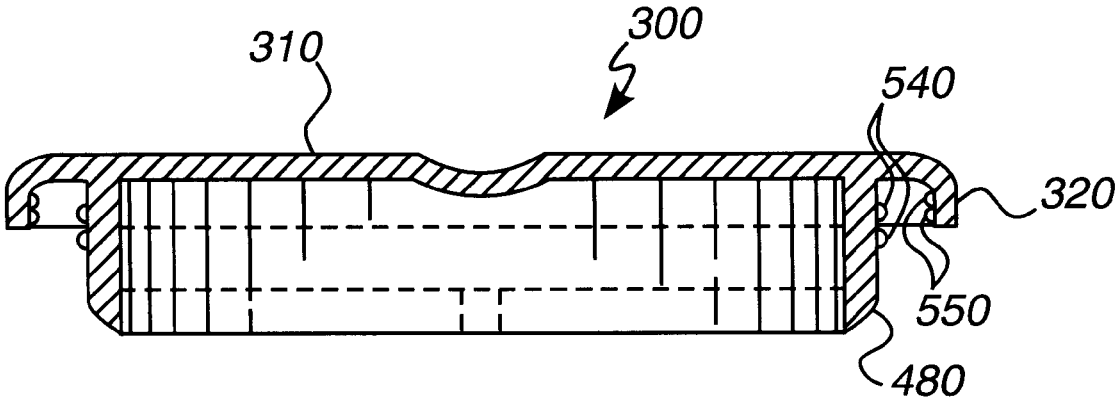
FIG. 3 is a sectional view of the closure sealing valve as it is attached to the closure of the present invention.

As shown in FIG. 3, depending from closure member 310 is depending annular valve 480. Annular valve 480 is spaced apart from annular depending closure wall 320 a distance which is represented by the difference in the radial distance between the outer surface of the annular neck finish wall 120 and the center of the circumferential opening 130 on the one hand and the radial distance between the inner surface of annular wall 120 and the center of the circumferential opening 130 on the other hand. Preferably valve 480 includes a taper proximate to its lower edge which permits initial engagement of the valve 480 to the inner periphery of the neck finish 100 opening upon application of the closure 300 to the neck finish 100. Optionally, valve 480 contains at least one and preferably a plurality of annular sealing beads 540 depending from the outer surface of the closure valve which are compressed against the inner surface of the container neck annular wall 120 to form a seal as the closure 300 is snapped onto the container neck 100. Annular sealing beads 540 also contribute to the sealing force of the closure disk 310 against the container neck finish 100 as beads 540 lock beneath corresponding flanges on the inner surface of the container neck 100 (not shown).

Optionally, sealing engagement between the closure 300 and the mating portions of the exterior of the container neck annular wall 120 may be further improved by including one or more annular sealing beads 550 extending around at least a portion of the interior surface of the closure depending annular skirt 320. In the preferred embodiment an annular sealing bead 550 is positioned on annular wall 320 proximate of closure element 310 and is located and dimensioned to engage and cooperatively secure closure 300 to an annular ring flange or groove 210 on neck finish 100 when the cap is snapped onto the neck finish 100.

Cap 300 when used in combination with neck finish 100 of the present invention permits the placement of the cap on the neck finish by snap-on or twist-on application. By preferably utilizing eight or nine threads 240 and 430, it is not necessary to screw the cap on or off the neck. However, by twisting the cap it is possible to obtain an even more secure closure when used by the ultimate consumer, while at the same time providing a leak proof container at the capping station without the necessity of so twisting.

Figure 7:
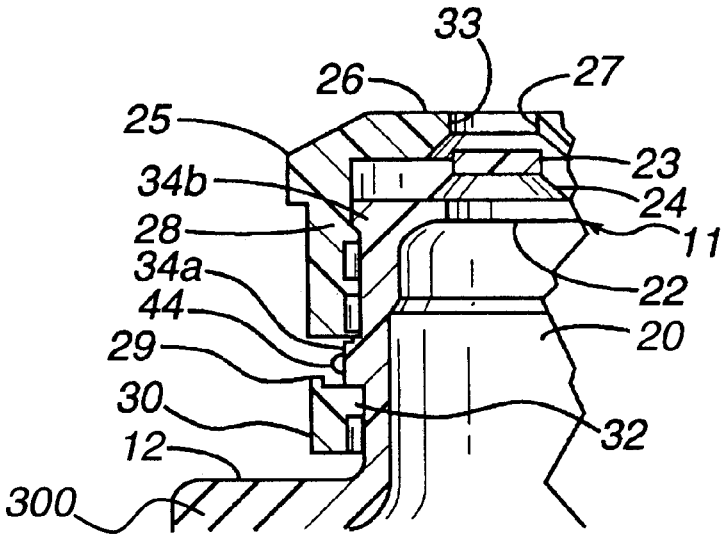
FIG. 7 is a vertical cross-section through a portion of a resealable push-pull pour spout closure with the push-pull cap in an open position.
Figure 7A:
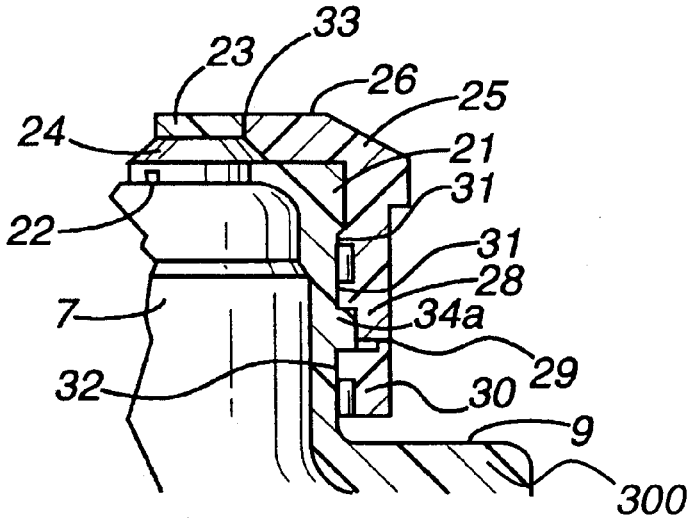
FIG. 7A is a vertical cross-section through a portion of the resealable push-pull pour spout closure with the push-pull cap in a closed position.

FIGS. 7 and 7A provide a second preferred embodiment of the invention in which the cap 300 shown in FIGS. 1–6 is optionally configured with a resealable push-pull pour spout closure. The closure is preferably made of high density polyethylene which also is made of high density polyethylene, except for pour spout 20 which is preferably low density polypropylene. As shown in FIGS. 7–7A and 8–8A the portion of the closure extending below seal disc 12 can be configured in accordance with any of the embodiments shown in FIGS. 1–6 and 1A–6A as described above.

Referring to FIGS. 7 and 7A, an opening 19 is preferably formed in the center of seal disc 12 with an upstanding cylindrical pour spout 20 positioned in registry with opening 19. The upper end of the pour spout 20 includes a secondary top portion 21 which is apertured at 22. A closure plug 23 is positioned on the secondary top portion 21 in spaced relation to aperture 22 by a plurality of circumferentially spaced angularly arranged upwardly extending supports 24. A push-pull cap 25 is positioned on the upstanding cylindrical pour spout 20 and has a top surface 26 with a central opening 27 which is designed to register with the plug 23 to form a secondary closure when the push-pull cap 25 is in a closed position resting on the secondary top portion 21 of the upstanding cylindrical pour spout 20, as illustrated in FIG. 7A.

Figure 10:
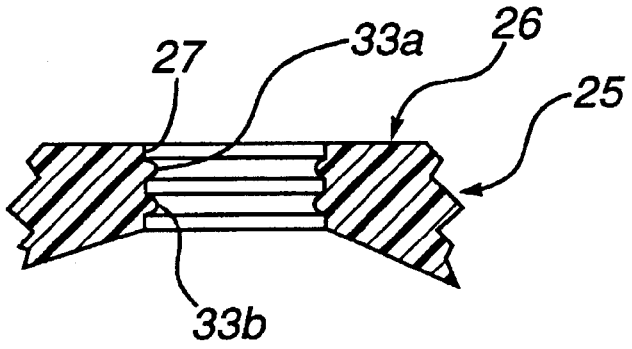
FIG. 10 is an enlarged partial section view of the secondary opening of the push-pull cap.
Figure 10A:
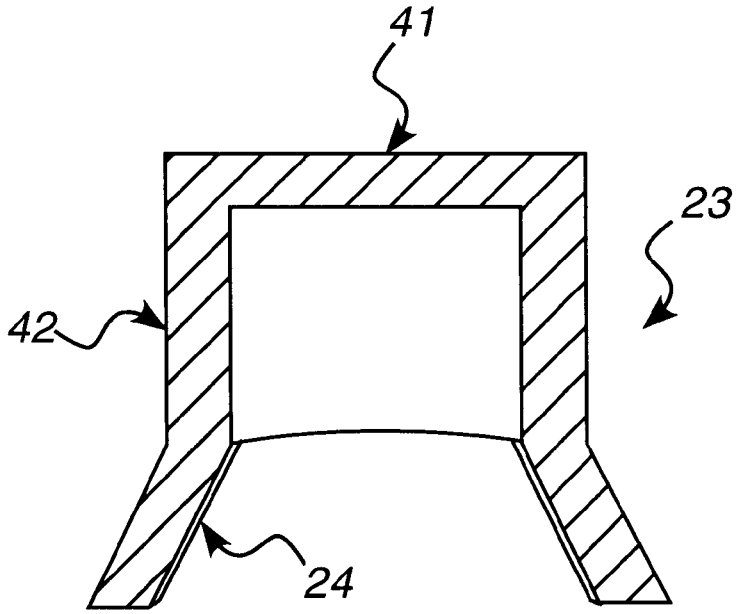
FIG. 10A is an exploded view of the secondary closure plug of the present invention.

Referring to FIG. 10A, the plug 23 is formed by a circular closure disk 41 having an integrally molded annular skirt 42 depending from the periphery of the disk 41. The sidewall of skirt 42 is dimensioned to be thin enough to allow inward deformation of the sidewall upon contact with the central opening surface 27 of spout cap 25 while at the same time being thick enough to ensure that the plug 23 will not break off with repeated use. Skirt 42 attaches plug 23 to the angular supports 24 thereby defining a hollow cavity 43 for the plug interior.

Located on the inner surface of central opening 27 is at least one, but preferably a pair of annular, preferably arcuate, flanges 33 which radially project into opening 27. As shown in FIG. 10, a pair of annular flanges 33*a* and 33*b* are integrally molded with the inner surface of central opening 27. A pair of flanges 33*a* and 33*b* are especially preferable for sealing fluids such as water. However, a single flange is sufficient for containers used for fluids having a higher viscosity such as fruit juice. The radially projecting flanges 33 engage depending plug skirt 42 to form a leak tight seal for the spout 20. The attachment of skirt 42 to the periphery of disk 41 increases the structural flexibility of the plug 23 thereby forcing the plug skirt 42 to flex and inwardly deform upon engagement with radially projecting flanges 33. This deformation causes a form fit which increases the tightness of the secondary closure seal thereby resulting in a superior leak-tight arrangement when compared to other designs currently in the state of the art.

Figure 8:
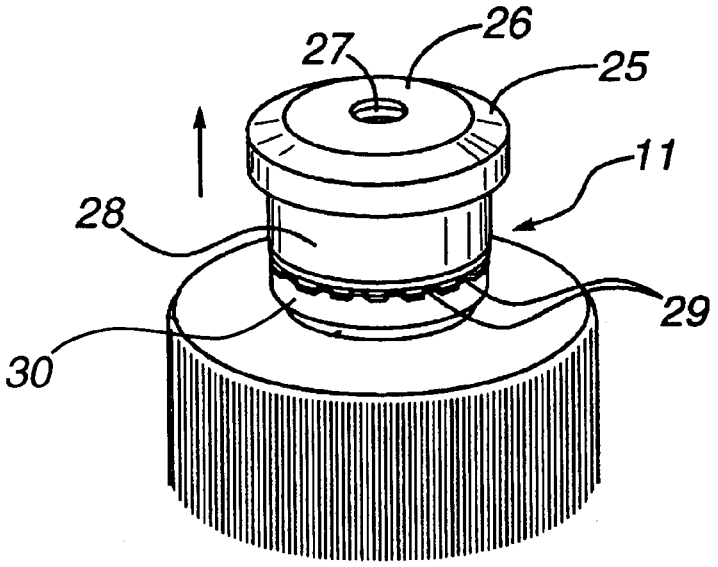
FIG. 8 is a perspective view of the resealable push-pull pour spout closure.
Figure 8A:
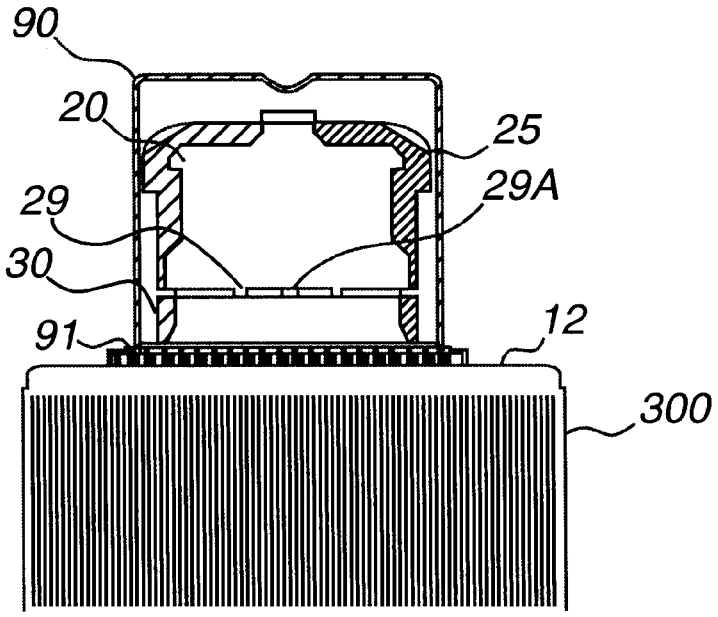
FIG. 8A is a sectional view of the resealable push-pull pour spout closure with tamper evident dust cover installed.
Figure 9:
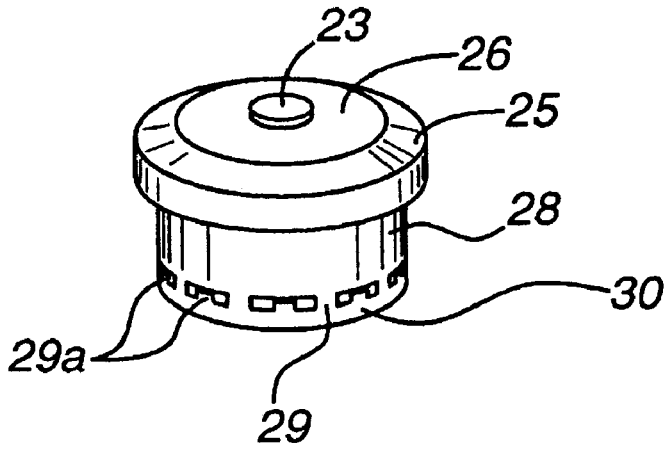
FIG. 9 is a perspective view of a portion of the push-pull cap.

Preferably, push-pull cap 25 has a depending cylindrical body member 28 with a plurality of annularly spaced frangible elements 29 connected on its lower perimeter edge to a secondary tamper indicating band 30. The cylindrical body member 28 has a pair of vertically spaced internal annular flanges 31 which slidably engage the outer surface of the upstanding cylindrical pour spout 20. The secondary tamper-evident band 30 also has an internal annular flange 32 which is slidably engaged at the exterior of the upstanding cylindrical pour spout 20. The upstanding cylindrical pour spout 20 has two outwardly extending annular flanges 34*a* and 34*b*, respectively on the exterior thereof. The internal annular flange 32 is oppositely disposed with respect to the secondary top portion 21 and outwardly extending flange 34a. The outwardly extending flange 34*a* is positioned above the seal disc 12 and is oppositely disposed to and between the annular flanges 31 and 32 on the cylindrical body member 28 and the secondary tamper evident band 30, respectively. As shown in FIGS. 8A and 9, the secondary-tamper evident band 30 may contain elevated bridge portions 29a extending from and/or between frangible elements 29, similar to and for the same purpose as the configuration shown on the bottom tamper-evident band 15 shown in FIGS. 2, 2A, 3 and 3A.

Figure 12:
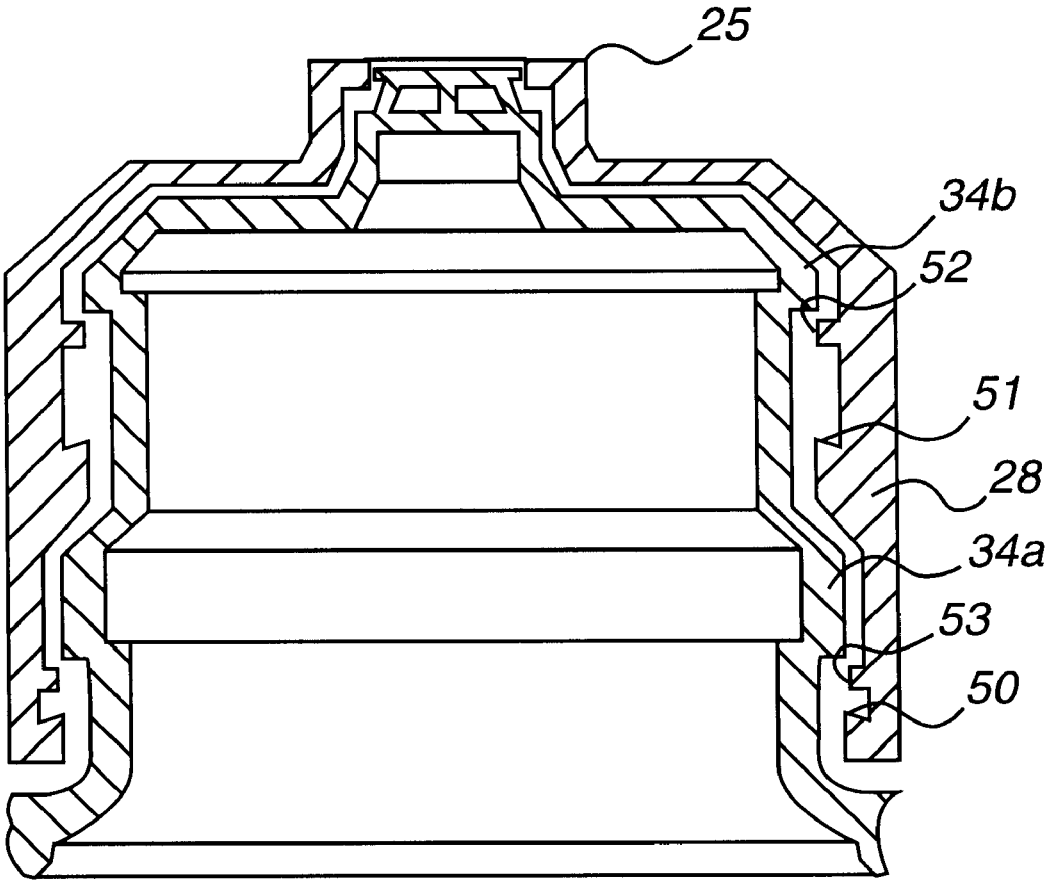
FIG. 12 is a vertical cross-section through a portion of a resealable push-pull pour spout and closure showing locking beads on the pour spout configured to engage locking beads on the pour spout closure.

In assembled form as illustrated in FIGS. 7–7A and 8–8A, the secondary tamper evident band 30 is joined by the frangible elements 29 to the cylindrical body member 28. The push-pull cap 25 is incapable of moving upwardly due to the interengagement of the internal annular flange 32 with the outwardly extending flange 34*a* on the cylindrical pour spout 20. Thus the cylindrical body member 28 of the push-pull cap 25 is incapable of vertical movement such as required to move the apertured top surface 26 above the plug 23 until sufficient force is applied to the push-pull cap 25 to break away the frangible elements 29 whereby the push-pull cap 25 can move to the position illustrated in FIG. 7 of the drawings wherein the opening 27 therein moves upwardly and away from the plug 23. The internal annular flanges 31 on the cylindrical body member 28 cannot move above the outwardly extending annular flange 34*b* on the upstanding cylindrical pour spout 20 so that the push-pull cap 25 cannot be removed therefrom. As shown in FIG. 12, flanges 31 and 32 on the cylindrical body member 28 of the pour spout closure 25 can be replaced with one or more continuous or discontinuous lower locking beads 50 and/or 51. Beads 50 and 51 may be conventionally shaped or may optionally be provided with upturned hook-like edges, similar in construction to the hook-shaped flange 370*c* on the tamper evident band 340, to engage complimentary shaped surfaces on pour spout flanges 34*a* and/or 34*b* to make it more difficult to disengage the push-pull cap 25 from the pour spout 20 as the push-pull cap 25 is moved from the closed to the open position. Additionally, the cylindrical body member 28 of the push-pull closure 25 may optionally be provided with one or more continuous or discontinuous upper locking beads 52 and/or 53, positioned to engage pour spout flanges 34*a* and/or 34*b* to prevent inadvertent opening of the push-pull cap 25 while in the closed position.

Figure 9A:
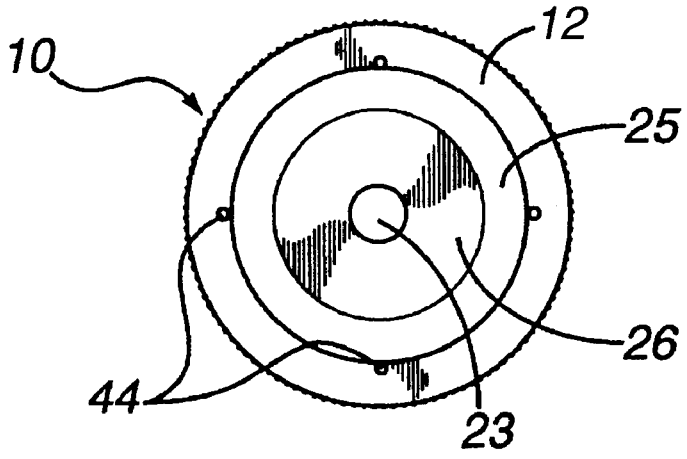
FIG. 9A is a top plan view of the push-pull cap.

As shown in FIGS. 7 and 9A, a plurality of circumferentially spaced dimples 44 optionally extend from the exterior wall of the pour spout 20. Dimples 44 facilitate breaking the frangible elements 29 connecting the tamper evident band 30 to the spout closure 25. Dimples 44 can break the frangible elements 29 by either axial or rotational movement of the spout closure 25 relative to the pour spout 20. Referring to FIG. 8, the push-pull pour spout closure 10 may be seen in assembled condition illustrating an outside rib surface 40 on the depending annular flange 13.

Figure 11:
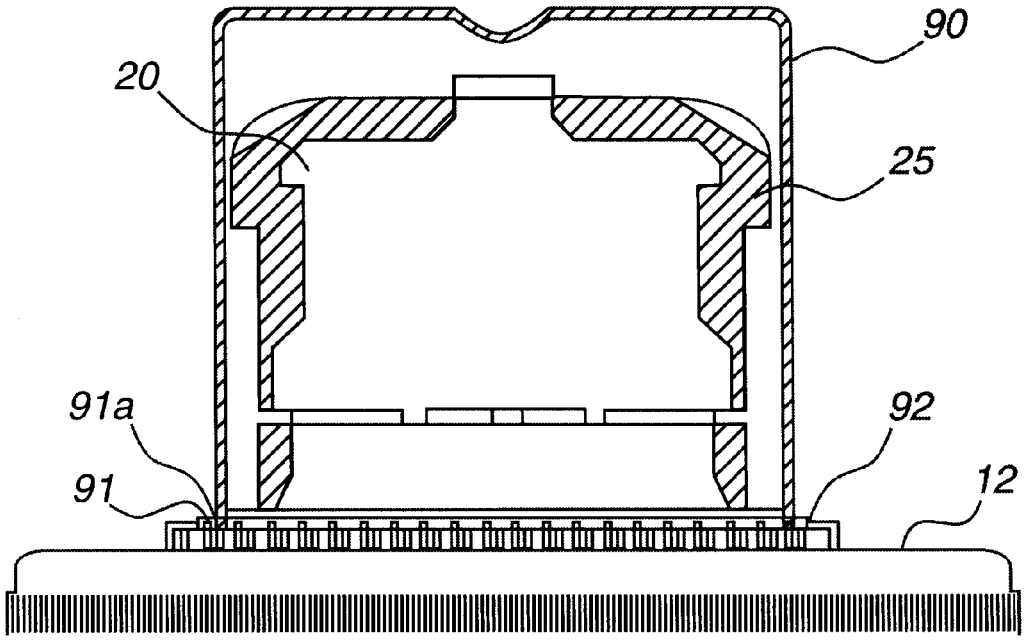
FIG. 11 is an exploded view of the resealable push-pull pour spout closure with tamper evident dust cover installed.

As shown in FIGS. 8A and 11, the present invention also optionally provides a dust cover 90 which encloses the push-pull pour spout closure when inserted on the container. The dust cover 90 may be optionally provided with an integral ratcheted tamper-evident sealing band 91 which engages teeth 91*a* integrally formed on the top of closure seal disc 12. Alternately, dust cover 90 may be provided with a tamper-evident sealing band containing at least one bead for a structure on the closure such as for example at least one bead integrally formed on the top of closure seal disc 12, wherein said beads may be either continuous or discontinuous around their circumference. Tamper-evident sealing band 91 remains intact upon initial installation of the dust cover 90 onto the container. Dust cover 90 and tamper-evident band 91 are separated by the breaking of a line of weakness 92 formed at the intersection of the dust cover 90 and tamper-evident band 91. The purpose of the dust cover is to provide an indication of whether the push-pull pour spout closure has been exposed subsequent to the sealing of the container. When a dust cover 90 used with a tamper-evident sealing band 91, the use of a band 30 on the lower edge of the pour spout push-pull cap 25 for providing tamper-evidency is no longer necessary and may optionally be eliminated.

While presently preferred embodiments of the invention have been shown and described in particularity, the invention may be otherwise embodied within the scope of the appended claims.

What is claimed is:

1. A tamper indicating closure configured for snap-on or screw-on application to a container, said closure comprising:

a. a top portion;

b. an annular depending skirt extending from said top portion, said depending skirt having an internal thread configuration adapted for engaging an external thread configuration on the neck portion of said container by snap-on application during initial installation of said closure to said container neck;

c. an annular valve depending from said top portion in spaced relation to said depending skirt; and d. a tamper indicating ring connected to said depending skirt by at least one circumferentially located frangible element;

e. at least one arcuate projection extending around at least a portion of said tamper indicating ring arranged for registration with a container neck portion on which said closure is positioned;

f. at least one member attached to said tamper-indicating ring which cooperates with at least one said arcuate projection to assist in breaking said tamper indicating ring during initial removal of said closure from said container neck;

wherein at least one said arcuate projection is held in place by an annular locking flange on said container neck as said member is pulled away from said arcuate projection by twist-off removal of said annular depending skirt to cause said tamper indicating ring to break at a weakened area.

2. A tamper indicating closure configured for snap-on or screw-on application to a container, said closure and container comprising in combination:

a. a closure top portion;

b. an annular depending skirt extending from said top portion, said depending skirt having an internal thread configuration adapted for engaging an external thread configuration on the neck portion of said container by snap-on application during initial installation of said closure to said container neck;

c. an annular valve depending from said top portion in spaced relation to said depending skirt; and d. a tamper indicating ring connected to said depending skirt by at least one circumferentially located frangible element;

e. at least one arcuate projection extending around at least a portion of said tamper indicating ring arranged for registration with a container neck portion on which said closure is positioned;

f. at least one member attached to said tamper-indicating ring which cooperates with at least one said arcuate projection to assist in breaking said tamper indicating ring during initial removal of said closure from said container neck;

wherein at least one said arcuate projection is held in place by an annular locking flange on said container neck as said member is pulled away from said arcuate projection by twist-off removal of said annular depending skirt to cause said tamper indicating ring to break at a weakened area.

3. The tamper indicating closure of claim 1, wherein said tamper indicating ring includes at least one annularly spaced elevated area extending axially towards said depending skirt, wherein said at least one elevated area defines a region of decreased ring spacing from said depending skirt.

4. The tamper indicating closure of claim 3, further comprising a plurality of said frangible elements and said elevated areas, wherein at least one of said frangible elements is connected to said depending skirt between two said elevated areas.

5. The tamper indicating closure of claim 4, wherein at least one other said frangible element is connected to said depending skirt from an elevated area.

6. The tamper indicating closure of claim 5 wherein said elevated areas extending from said annular ring are of a known vertical height, and said frangible elements are of a height greater than that of said known height of said elevated areas.

7. The tamper indicating closure of claim 4 wherein said elevated areas extending from said annular ring are of a known vertical height, and said frangible elements are of a height greater than that of said known height of said elevated areas.

8. The tamper indicating closure of claim 1, wherein said container neck contains at least one projection configured for engaging said frangible element(s) to disconnect said closure from said tamper evident band upon twist-off removal of said closure from said container neck.

9. The tamper indicating closure of claim 1, wherein said annular valve includes at least one annular sealing bead extending around at least a portion of the circumference of said valve and being configured for engagement with the interior surface of said container neck finish.

10. The tamper indicating closure of claim 1, wherein said annular depending skirt includes at least one annular sealing bead extending around at least a portion of the circumference of said skirt and being configured for engagement with the exterior surface of said container neck finish.

11. The tamper indicating closure of claim 10, wherein at least one said annular sealing bead engages a sealing bead or sealing groove on the exterior of said container neck finish.

12. The tamper indicating closure of claim 1, wherein said thread configurations contain eight or nine circumferentially spaced individual thread leads.

13. The tamper indicating closure of claim 1, wherein said thread leads are segmented or nonsegmented.

14. The tamper indicating closure of claim 1, wherein said container neck is configured with a recessed area in which said tamper indicating ring rests.

15. The tamper indicating closure of claim 14, wherein said recessed area improves tamper evidency protection by eliminating the ability to manually pry the closure upwardly from underneath the tamper indicating ring in order to remove said closure from said neck finish without breaking said tamper indicating ring.

16. The tamper indicating closure of claim 1, wherein at least one said internal thread engages at least one said external thread to permit said closure to be screwed on and off said container neck.

17. The tamper indicating closure of claim 1 or 2, wherein at least one said arcuate projection comprises a locking member extending radially inward from said tamper indicating ring at an angle to a plane normal with said tamper indicating ring.

18. The tamper indicating closure of claim 17, wherein said locking member is positioned adjacent to the bottom surface of said tamper indicating band.

19. The tamper indicating closure of claim 17, wherein at least a portion of the surface of said locking member lies substantially parallel to the interior surface of said tamper indicating band.

20. The tamper indicating closure of claim 1 or 2, further comprising a resealable push-pull pour spout closure assembly extending from said top portion of said closure, said push-pull pour spout closure assembly comprising:

A. a spout member defining a spout opening and having positioned in spaced relationship thereto a plug with at least one support member defining said relationship;

B. a slidable secondary closure member having a central opening therethrough for cooperation with said plug the improvement therein comprising said central opening having a diameter substantially the same as that of said plug, said central opening being defined by an inner surface having at least one annular seal flange projecting radially into said central opening for engagement with said plug.

21. The tamper indicating closure of claim 20 wherein said secondary closure member further comprises an annular wall depending from the periphery of said secondary closure member having at least one first internally extending annular flange being spaced a distance from said secondary closure member greater than the length of the inner surface of said central opening to permit said secondary closure member to slide and disengage said plug to permit a fluid to pass through said central opening.

22. The tamper indicating closure of claim 21, wherein said spout member includes at least one external flange for engaging at least one said internally extending annular flange to inhibit removal of said secondary closure member from said pour spout assembly.

23. The tamper indicating closure of claim 22, further comprising at least two said external flanges.

24. The tamper indicating closure of claim 21, further comprising a second tamper indicating ring connected to said annular wall.

25. The tamper indicating closure of claim 24, wherein said second tamper indicating ring is connected in vertical spaced relation to said annular wall by a plurality of circumferentially spaced second frangible elements.

26. The tamper indicating closure of claim 25, wherein said second tamper indicating ring includes a plurality of annularly spaced second elevated bridge portions extending axially towards said annular wall, wherein said second elevated bridge portions define areas of decreased ring spacing from said annular wall.

27. The tamper indicating closure of claim 26, wherein at least one said second frangible element is connected to said annular wall between two said second elevated bridge portions.

28. The tamper indicating closure of claim 26, wherein said second elevated bridge portions extending from said second tamper indicating ring are of a known vertical height, and said second frangible elements are of a height greater than that of said known height of said second elevated bridge portions.

29. The tamper indicating closure of claim 26, wherein at least one said second frangible element is connected to said annular wall from a second elevated bridge portion.

30. The tamper indicating closure of claim 24, further comprising a plurality of circumferentially spaced dimples extending from said spout member.

31. The tamper indicating closure of claim 30, wherein said dimples are spaced equally around the circumference of said spout member.

32. The tamper indicating closure of claim 30, wherein said dimples facilitate breaking a plurality of circumferentially spaced second frangible elements connecting said second tamper indicating ring to said annular wall.

33. The tamper indicating closure of claim 21, wherein said secondary closure member further comprises at least one second internally extending annular flange positioned to engage said at least one external flange to prevent inadvertent movement of said secondary closure member while said secondary closure member is in a closed position.

34. The tamper indicating closure of claim 33, further comprising at least two said second internally extending annular flanges.

35. The tamper indicating closure of claim 21, further comprising at least two said first internally extending annular flanges.

36. The tamper indicating closure of claim 21, wherein said central opening of said secondary closure member includes at least two said annular seal flanges.

37. The tamper indicating closure of claim 20, wherein at least one said annular seal flange is continuous or discontinuous.

38. The tamper indicating closure of claim 20, wherein said plug comprises a circular disk and an integral depending annular skirt extending from the periphery of said disk to attach said disk to said support member thereby defining a hollow cavity within said plug.

39. The tamper indicating closure of claim 20, further comprising a cover attached to said closure for enclosing said push-pull pour spout closure assembly.

40. The tamper indicating closure of claim 39 wherein said cover is attached to said closure by a cover tamper indicating ring.

41. The tamper indicating closure of claim 40, wherein said third tamper indicating ring includes ratcheted teeth for engaging ratcheted teeth positioned on said top portion of said closure.

42. The tamper indicating closure of claim 40, wherein said third tamper indicating ring includes at least one annular bead for engaging at least one annular bead positioned on said closure.

43. The tamper indicating closure of claim 42, wherein at least one of said annular beads is continuous or discontinuous.

44. The tamper indicating closure of claim 40, wherein said secondary closure member has no means for providing tamper evidency.

45. The tamper indicating closure of claim 39, wherein said cover has no means for providing tamper evidency.

46. The tamper indicating closure of claim 39, wherein said cover is configured for snap-on installation to said closure.

47. The tamper indicating closure of claim 1 or 2 wherein at least one said member remains attached to said tamper indicating ring and said closure depending skirt during removal of said closure from said container.

48. The tamper indicating closure of claim 1 or 2 wherein at least one said member comprises one ratchet in a pair of cooperating ratchets wherein one ratchet of said pair depends from said tamper indicating ring and the other ratchet of said pair depends from said closure depending skirt.

49. The tamper indicating closure of claim 40, further comprising at least one other said cooperating ratchet pair.

* * * * *